US007735569B2

(12) United States Patent
Green

(10) Patent No.: US 7,735,569 B2
(45) Date of Patent: Jun. 15, 2010

(54) FIRE PROTECTION SPRINKLER WITH PLASTIC PIP CAP

(75) Inventor: Brian S. Green, Nashville, MI (US)

(73) Assignee: The Viking Corporation, Hastings, MI (US)

( * ) Notice: Subject to any disclaimer, the term of this patent is extended or adjusted under 35 U.S.C. 154(b) by 11 days.

(21) Appl. No.: 12/131,513

(22) Filed: Jun. 2, 2008

(65) Prior Publication Data

US 2009/0294140 A1 Dec. 3, 2009

(51) Int. Cl.
*A62C 37/08* (2006.01)

(52) U.S. Cl. ..... 169/37; 169/41; 239/498; 239/504; 239/524; 239/DIG. 19

(58) Field of Classification Search ..... 169/37, 169/41; 239/498, 504, 524, DIG. 19
See application file for complete search history.

(56) References Cited

U.S. PATENT DOCUMENTS

| | | | | |
|---|---|---|---|---|
| 2,370,243 | A | 2/1945 | Henshaw | |
| 4,109,727 | A | 8/1978 | Job et al. | |
| 4,217,961 | A * | 8/1980 | Wotton | 169/41 |
| 4,991,656 | A | 2/1991 | Polan | |
| 5,020,601 | A * | 6/1991 | Retzloff et al. | 169/37 |
| 5,299,645 | A | 4/1994 | Hoening et al. | |
| 5,494,114 | A | 2/1996 | Hoening et al. | |
| 5,713,524 | A | 2/1998 | Greene et al. | |
| 6,854,668 | B2 * | 2/2005 | Wancho et al. | 239/498 |
| 6,868,916 | B2 | 3/2005 | Petersen | |
| 7,314,093 | B2 | 1/2008 | Orr | |
| 2005/0081380 | A1 | 4/2005 | Knoblauch | |
| 2007/0007018 | A1 | 1/2007 | Kong | |

* cited by examiner

*Primary Examiner*—Steven J Ganey
(74) *Attorney, Agent, or Firm*—Harness, Dickey & Pierce, P.L.C.

(57) ABSTRACT

A sprinkler assembly includes a sprinkler body having a base and a frame extending from the base. The base has a passage extending therethrough defining an inlet and an outlet. A deflector is mounted to the frame and spaced from the outlet, which is configured to deflect fluid flowing from the outlet in a radial pattern. A trigger assembly extends between the frame and the base and is adapted to support a plug in the outlet and release the plug when a temperature associated with a fire condition is detected. The plug is made from plastic and can include a reinforcing insert.

6 Claims, 2 Drawing Sheets

FIRE PROTECTION SPRINKLER WITH PLASTIC PIP CAP

FIELD

The present disclosure relates to a sprinkler and more particularly to an automatic sprinkler.

BACKGROUND

The statements in this section merely provide background information related to the present disclosure and may not constitute prior art.

Automatic sprinklers have long been used to disperse a fluid to control a fire. Typically, the fluid utilized in such systems is water; although systems have also been developed to disburse foam and other materials. Historically, sprinkler assemblies include a solid metal base connected to a pressurized supply of water and a deflector that is used to disperse the water flow. The deflector is typically spaced from the outlet of the base by a frame. A trigger assembly is mounted between the base and a plug, which is positioned over the orifice of the base, to hold the plug in place over the orifice to thereby seal the orifice. When the temperature surrounding the sprinkler assembly is elevated to a temperature associated with a fire condition, the trigger assembly releases the plug and water is allowed to flow from the orifice of the sprinkler assembly.

For proper seating and release, the plug needs to be rigid, corrosion resistant and adapted to engage the trigger assembly in the assembled condition. Typical plugs, commonly referred to as pip caps, have been made from metal such as copper or brass. However, the costs of these materials are rapidly increasing and therefore, a less expensive alternative which is easier to manufacture is desirable. Furthermore, typical plugs have been formed from stampings or, alternatively, they are machined. The cost of a machined pip cap can be generally on the order of ten times greater than a stamped pip cap.

SUMMARY

According to one form of the invention, a sprinkler assembly includes a sprinkler body having a base and a frame extending from the base. The base has a passage extending therethrough defining an inlet and an outlet. A deflector is mounted to the frame and spaced from the outlet, which is configured to deflect fluid flowing from the outlet in a radial pattern. A trigger assembly extends between the frame and the base and is adapted to support a plug/pip cap in the outlet and release the plug/pip cap when a temperature associated with a fire condition is detected. The plug/pip cap is made from a plastic material and includes a cylindrical body and an annular rim extending therefrom. A metal reinforcing insert is disposed in the plastic plug and can overlap a portion of the annular rim. The reinforcing insert can further define a frusto-conical seat surface for engaging the trigger. The reinforcing insert can be molded within the pip cap or inserted or press fit into the pip cap, and can include an aperture in communication with a hollow cavity within said pip cap.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
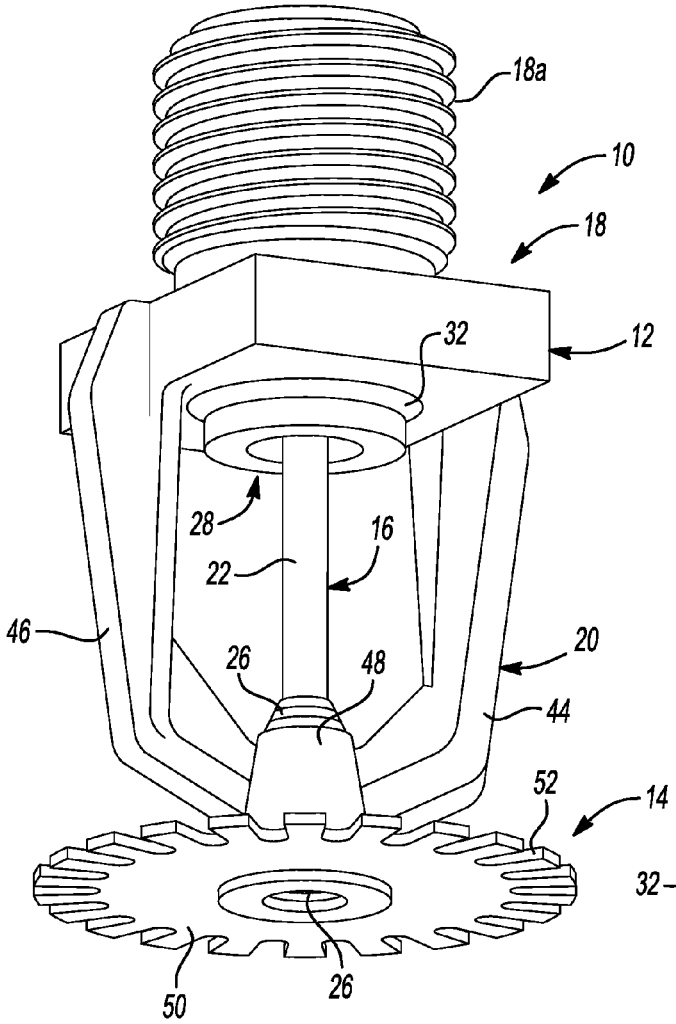
FIG. 1 is a perspective view of a sprinkler assembly of the present invention.
Figure 2:
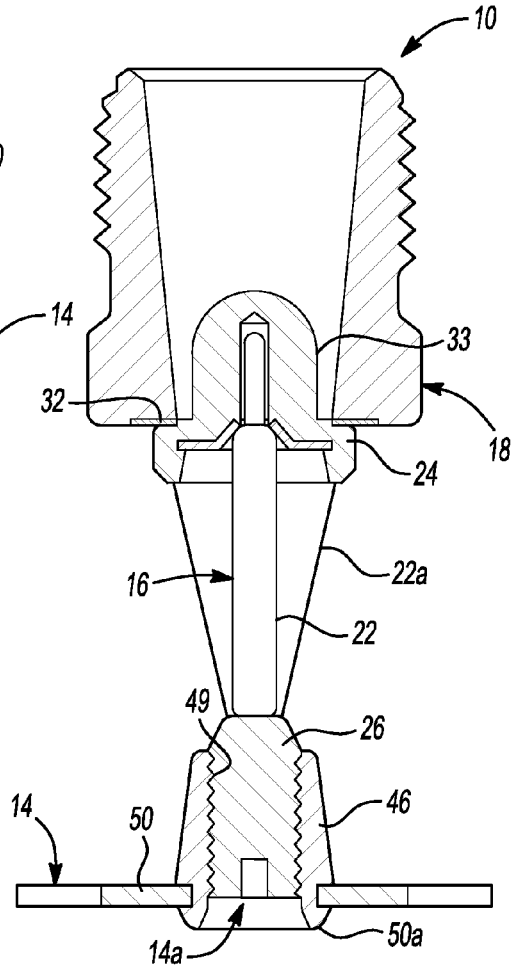
FIG. 2 is a sectional view of the sprinkler assembly taken along line II-II of FIG. 1.

Referring to FIGS. 1 and 2, the numeral 10 generally designates a sprinkler assembly of the present disclosure. Sprinkler assembly 10 includes a sprinkler body 12, a deflector 14, and a trigger assembly 16. Body 12 can include a base 18 and a frame 20 to which deflector 14 is mounted. Base 18 can include an externally threaded portion 18*a*, which allows sprinkler body 12 to be threaded onto a fire extinguishing fluid supply line or pipe.

In the illustrated embodiment, trigger assembly 16 includes a frangible bulb 22, which extends between base 18 and frame 20 and which is held in place and further urged toward outlet opening 24 of base 18 by a compression screw 26 to thereby maintain a pip cap 28 in the outlet opening 24, which when opened enables the flow of fire extinguishing fluid through base 18, as will be more fully described below. Alternatively, it should be understood that the trigger assembly 16 can be a fusible linkage type of trigger assembly.

Figure 3:
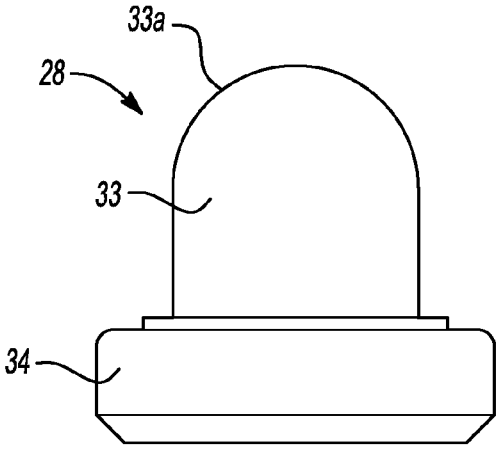
FIG. 3 is a side plan view of the plastic pip cap according to the principles of the present disclosure.
Figure 4:
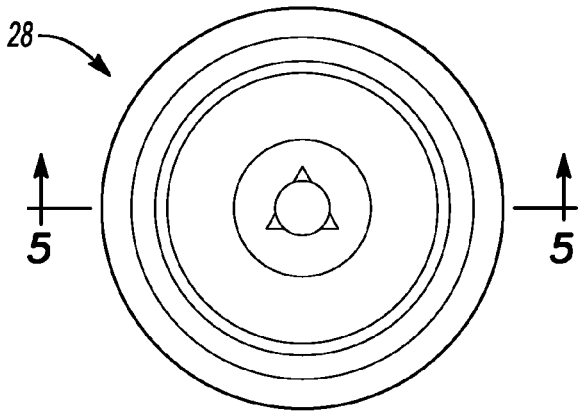
FIG. 4 is a top plan view of the plastic pip cap of FIG. 3.
Figure 5:
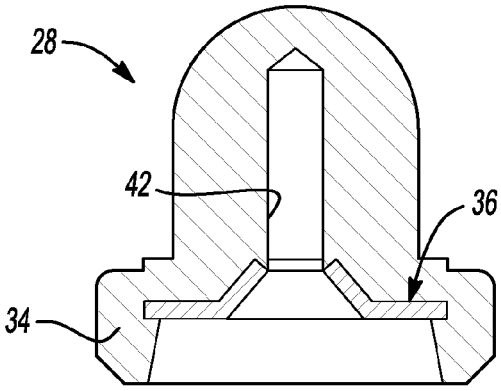
FIG. 5 is a sectional view taken along line V-V of FIG. 4.
Figure 6:
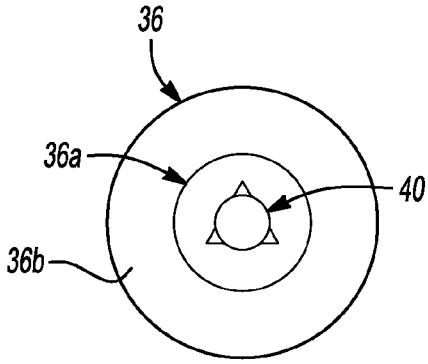
FIG. 6 is a top plan view of a reinforcement insert of the pip cap.
Figure 7:
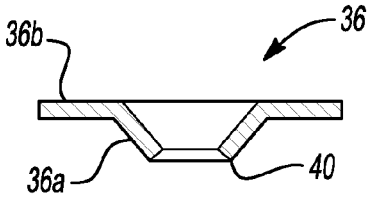
FIG. 7 is a sectional view of the reinforcement insert taken along line VII-VII of FIG. 6.

As best seen in FIG. 2, bulb 22 is seated and held in outlet opening 24 by pip cap 28, which in turn urges a ring-shaped or annular spring seal 32 to seal outlet opening 24 under the force of the bulb 22. Referring to FIGS. 3-5, pip cap 28 is made from plastic and comprises a cylindrical body portion 33 with an annular rim 34 extending from one end for receiving the annular spring seal 32 thereagainst. A metal reinforcing insert 36 is disposed in the plastic pip cap 28 and can overlap a portion of the annular rim 34. The reinforcing insert 36 can be made from stainless steel or another metal and can be molded or inserted within the pip cap 28. The cylindrical body portion 33 can have a semi-hemispherical shaped end portion 33*a* or alternatively can have a conical shape, flat shape, or other geometric shape so long as it does not present lodgment issues when the trigger assembly releases.

Insert 36 can include a frusto conical portion 36*a* defining a central aperture 40 that is sized to receive the lower end of bulb 22. The pip cap can include a hollow cavity 42 adjacent to the aperture 40 in insert 36 for receiving an end of the bulb 22. Bulb 22 can form a shoulder 42 (FIG. 2) which rests on insert 36 so that bulb 22 is supported in pip cap 28 by insert 36. The insert 36 can also include an annular flange portion 36*b* extending radially from frusto conical portion 36*a*, so as to overlap the annular rim 34.

Positioned around pip cap 28 is spring seal 32 which is adjacent to the annular rim 34 and which seals opening 24 when compressed against base 18 by pip cap 28. In an uncompressed state, spring seal 32 can assume a convex configuration. When compressed, however, spring seal 32 has a generally planar configuration (FIG. 2). Spring seal 32 is preferably formed form a spring metal, such as nickel alloy, and, further, is coated with Teflon tape, which provides a seal. In this manner, when the compression force is released from spring seal 32, spring seal 32 will return to its convex configuration and generate a force to push pip cap 28 away from outlet opening 24, which reduces the chances of the pip cap interfering with the flow of fire extinguishing fluid from opening 24.

As noted above, deflector 14 is mounted to frame 20. As best seen in FIG. 1, frame 20 can include a pair of frame arms 44 and 46 that extend from base 18. Frame arms 44 and 46 comprise generally L-shaped arms that are joined at their respective ends by a central boss 48. Boss 48 includes an internally threaded aperture or bore 49 (FIG. 2) through which compression screw 26 is threaded to engage and compress bulb 22 against pip cap 28. In order to permit sprinkler body 20 to deliver an appropriate quantity of fire extinguishing fluid during the initial stages of fire development, bulb 22 preferably has a trigger temperature—that is a temperature at which the bulb explodes, typically but not limited to between approximately 145° F. and 165° F.

Referring to FIG. 1, deflector 14 can be formed from a generally planar, circular member 50. Planar member 50 of deflector 14 is formed with a central aperture 50*a*, such as a double hex opening, to attach deflector 14 to boss 46.

To disperse the fire extinguishing fluid in the desired spray pattern, a plurality of spaced slots 52 can be formed at the perimeter of member 50, which extend into member 50 from its outer perimeter edge. The slots are preferably designed and arranged to provide a desired spray pattern.

Sprinkler assembly 10 can be configured to have a discharge coefficient or "K value" (which is the measurement of the flow of water in gallons per minute through the sprinkler head divided by the square-root of the water pressure delivered to the sprinkler in pounds per square inch gauge) for a particular desired application. Discharge coefficient or K factor of a sprinkler is determined by flow testing. For example, the flow testing in increments of pressure from an initial pressure measurement and then decreased in the same increments back to the original pressure value. The K value then is determined from the actual flow in gallons per minute divided by the square-root of the pressure of the supplied water and psig at each increment, which are then averaged from all the incremental values which determines the K factor of the sprinkler.

The response time of a sprinkler is referred to as "RTI", which is a measure of thermal-sensitivity of a sprinkler. RTI is the product of the thermal time constant of the trigger in units of seconds times the square-root of the velocity of the gas across the trigger. Sprinkler assembly 10 can have a desired RTI for any particular application.

Sprinkler 10 may be installed as a pendent or an upright, and could also be a concealed sprinkler with a cover assembly mounted over the deflector and over frame 20 of sprinkler assembly 10.

What is claimed is:

1. A pip cap for a sprinkler assembly, comprising:

a plastic body including an annular rim extending therefrom;

a metal reinforcing insert disposed in said plastic body and defining a seat surface adapted for engaging a trigger assembly, wherein said metal reinforcing insert radially overlaps a portion of said annular rim, wherein said metal reinforcing insert is molded within the plastic body such that a radially outer portion of said reinforcing insert engages an annular groove in said annular rim.

2. The pip cap according to claim 1, further comprising an annular spring seal disposed against said annular rim.

3. The pip cap according to claim 1, wherein said body defines a hollow cavity adjacent to said metal reinforcing insert, said metal reinforcing insert including an aperture therethrough in communication with said hollow cavity.

4. A sprinkler assembly, comprising:

a body having a base and a frame extending from the base, said base having a passage extending therethrough and defining an inlet and an outlet;

a deflector mounted to said frame and spaced from the outlet;

a plastic pip cap disposed in said outlet of said body, said plastic pip cap including a cylindrical body with an annular rim extending radially therefrom;

a metal reinforcing insert molded within said plastic pip cap such that a radially outer portion of said reinforcing insert engages an annular groove in said annular rim;

an annular spring seal disposed between said annular rim and said base of said body; and a heat sensitive trigger extending between said frame and said plastic pip cap, wherein said reinforcing insert defines a seat surface for directly engaging said heat sensitive trigger.

5. The sprinkler assembly of claim 4, wherein said cylindrical body includes a semi-hemispherical end portion.

6. The sprinkler assembly of claim 4, wherein said annular spring seal is formed from a metallic material coated with a polymeric material.

* * * * *